US009398376B2

(12) United States Patent
Noro et al.

(10) Patent No.: US 9,398,376 B2
(45) **Date of Patent: *Jul. 19, 2016**

(54) ELECTROACOUSTIC TRANSDUCER

(71) Applicant: Yamaha Corporation, Hamamatsu-shi, Shizuoka-Ken (JP)

(72) Inventors: Masao Noro, Hamamatsu (JP); Akira Arai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/519,632

(22) Filed: Oct. 21, 2014

(65) Prior Publication Data

US 2015/0110305 A1 Apr. 23, 2015

(30) Foreign Application Priority Data

Oct. 22, 2013 (JP) ..... 2013-219606
Nov. 19, 2013 (JP) ..... 2013-239320
Sep. 30, 2014 (JP) ..... 2014-200338

(51) Int. Cl.
*H04R 1/00* (2006.01)
*H04R 7/20* (2006.01)
(Continued)

(52) U.S. Cl.
CPC .. *H04R 7/20* (2013.01); *H04R 7/12* (2013.01); *H04R 7/18* (2013.01); *H04R 9/06* (2013.01);
(Continued)

(58) Field of Classification Search
CPC ..... H04R 1/24; H04R 7/12; H04R 7/127; H04R 7/16; H04R 7/18; H04R 7/20; H04R 9/06; H04R 9/063; H04R 2207/021; H04R 7/14; H04R 31/00; H04R 31/003; H04R 2231/003
USPC ..... 381/182, 186, 190, 398, 423, 424, 430, 381/432; 181/147, 163, 164, 165, 171, 172, 181/173
See application file for complete search history.

(56) References Cited

U.S. PATENT DOCUMENTS 1,667,149 A * 4/1928 Gerlach ..... 381/163
4,584,439 A * 4/1986 Paddock ..... 381/89
(Continued)

FOREIGN PATENT DOCUMENTS

EP 0 077 228 A2 4/1983
EP 1182907 B1 2/2002
(Continued)

OTHER PUBLICATIONS

European Office Action dated Oct. 7, 2015, for EP Patent Application No. 14189882.5, six pages.
(Continued)

*Primary Examiner* — Huyen D Le
(74) *Attorney, Agent, or Firm* — Morrison & Foerster LLP

(57) ABSTRACT

An electroacoustic transducer includes a diaphragm including a pair of convex surfaces respectively including convex surfaces of a pair of longitudinal split tubular members. A valley is formed between one side portions of the pair of longitudinal split tubular members. The electroacoustic transducer further includes: a converter configured to convert between a vibration of the diaphragm in a depth direction of the valley and an electric signal corresponding to the vibration; and a supporter supporting other side portions of the pair of longitudinal split tubular members of the diaphragm so as to allow the other side portions to vibrate in a vibration direction of the vibration.

15 Claims, 12 Drawing Sheets

(51) Int. Cl.

| | |
|---|---|
| ***H04R 9/06*** | (2006.01) |
| ***H04R 7/18*** | (2006.01) |
| ***H04R 7/12*** | (2006.01) |
| *H04R 7/14* | (2006.01) |
| *H04R 9/00* | (2006.01) |
| *H04R 17/00* | (2006.01) |
| *H04R 31/00* | (2006.01) |

(52) U.S. Cl.
CPC ... *H04R 7/14* (2013.01); *H04R 9/00* (2013.01); *H04R 9/063* (2013.01); *H04R 17/00* (2013.01); *H04R 31/00* (2013.01); *H04R 2207/021* (2013.01); *H04R 2231/003* (2013.01)

(56) References Cited

U.S. PATENT DOCUMENTS

| | | | | |
|---|---|---|---|---|
| 4,903,308 | A * | 2/1990 | Paddock et al. | 381/430 |
| 5,570,429 | A * | 10/1996 | Paddock | 381/423 |
| 8,135,160 | B2 | 3/2012 | Mitobe et al. | |
| 2005/0175212 | A1 | 8/2005 | Murayama et al. | |
| 2006/0050924 | A1 | 3/2006 | Ohara | |
| 2007/0147651 | A1 | 6/2007 | Mitobe et al. | |
| 2011/0044489 | A1 | 2/2011 | Saiki et al. | |

FOREIGN PATENT DOCUMENTS

| | | | |
|---|---|---|---|
| EP | 2 239 959 | A1 | 10/2010 |
| JP | 2002-078079 | A | 3/2002 |
| JP | 2007-174233 | A | 7/2007 |
| WO | WO-97/46046 | A1 | 12/1997 |

OTHER PUBLICATIONS

European Search Report dated Apr. 7, 2015, for EP Patent Application No. 14189882.5, ten pages.

* cited by examiner

ELECTROACOUSTIC TRANSDUCER

CROSS REFERENCE TO RELATED APPLICATION

The present application claims priority from Japanese Patent Application Nos. 2013-219606 filed on Oct. 22, 2013, 2013-239320 filed on Nov. 19, 2013, and 2014-200338 filed on Sep. 30, 2014, the disclosures of which are herein incorporated by reference in its entirety.

BACKGROUND

1. Technical Field

The present invention relates to an electroacoustic transducer for a speaker configured to reproduce sound by vibrating convex surfaces and a microphone configured to pick up sound.

2. Description of the Related Art

A typical dynamic speaker includes a vibration plate or a diaphragm and a voice coil motor which moves the vibration plate back and forth to cause piston motion for producing sound. The typical dynamic speaker functions substantially as a point sound source and exhibits wide directivity at low frequencies but exhibits sharp directivity over a frequency range equal to or higher than a frequency at which the diameter of a bore of the vibration plate is substantially equal to a half-wavelength of the reproduced sound. Thus, a small speaker using a vibration plate having a small bore is used to reproduce sound at high frequencies. This also applies to a dynamic microphone whose operation principle is reverse to that of the dynamic speaker. That is, a small microphone using a vibration plate having a small bore is used to pick up high frequencies with wide directivity.

In a riffell speaker, in contrast, a vibration plate is constituted by a pair of rectangular curved plates, and the directivity is wide at middle and high frequencies. Also, sound produced by the riffell speaker radiates in a widthwise direction of the vibration plate or a horizontal direction along a direction of curve of the vibration plate and hardly radiates in a lengthwise direction of the vibration plate or a vertical direction.

Patent Document 1 (Japanese Patent Application Publication No. 2002-78079) and Patent Document 2 (Japanese Patent Application Publication No. 2007-174233) disclose conventional riffell speakers.

Patent Document 1 discloses a speaker in which a conductor pattern as a voice coil is printed on a central portion of a polymeric resin film, and the central portion is folded and bonded to form a vibration plate which includes first and second curved vibration portions and a planar plate portion having the conductor pattern, the planar plate portion and first and second curved vibration portions being formed integrally with each other. The planar plate portion of the vibration plate is disposed in a magnetic gap formed in a magnetic circuit, and distal edges of the first and second curved vibration portions are secured to a supporter.

Patent Document 2 discloses a speaker in which a central portion of a vibration plate is folded so as to form a recessed portion in which a flat voice coil wound in an oval annular shape is disposed in two magnetic gaps spaced apart from each other in an up and down direction. Also in this speaker, an outer peripheral portion of the vibration plate is secured to an annular frame.

SUMMARY

However, since the riffell speaker of this type is not appropriate for reproducing sound at low frequencies, a multispeaker system using a speaker for low frequencies (i.e., a woofer) needs to be additionally configured to reproduce sound over the full range of audible frequencies.

This invention has been developed to provide a low-cost electroacoustic transducer using one unit for exhibiting wide directivity over a wide frequency range extending from low frequencies to high frequencies.

The present invention provides an electroacoustic transducer including: a diaphragm including a pair of convex surfaces including respectively convex surfaces of a pair of longitudinal split tubular members, a valley being formed between one side portions of the pair of longitudinal split tubular members; a converter configured to convert between a vibration of the diaphragm in a depth direction of the valley and an electric signal corresponding to the vibration; and a supporter supporting other side portions of the pair of longitudinal split tubular members of the diaphragm so as to allow said other side portions to vibrate in a vibration direction of the vibration.

The present invention also provides an electroacoustic transducer including: a diaphragm including a pair of convex surfaces including respectively surfaces of a pair of convex members, a distance between one edge portions of the pair of convex surfaces being less than a distance between other edge portions of the pair of convex surfaces so as to form a valley between the pair of convex surfaces; a converter configured to convert between a vibration of the diaphragm in a depth direction of the valley and an electric signal corresponding to the vibration; a support body supporting the diaphragm and the converter; and an edge member including one of opposite side edges which is secured to an outer peripheral portion of the diaphragm and another of the opposite side edges which is secured to the support body, the edge member supporting the outer peripheral portion of the diaphragm so as to allow the diaphragm to vibrate in a vibration direction of the vibration of the diaphragm.

EFFECTS

In the case where the electroacoustic transducer according to the present invention is applied to a speaker, this speaker provides a higher sound pressure at low frequencies due to piston motion and has wide directivity at middle and low frequencies due to radiation of reproduced sound from the respective convex surfaces of the pair of longitudinal split tubular members. As a result, a full-range speaker unit having wide directivity over a wide range extending from low frequencies to middle and high frequencies can be achieved by a single speaker unit with low cost. Also in the case where the electroacoustic transducer according to the present invention is applied to a microphone, this microphone can pick up sound with wide directivity over a frequency range extending from low frequencies to high frequencies.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

The present inventors have analyzed an operation principle of a riffell speaker and found that the width of directivity is determined due, not to vibrations at high frequencies being concentrated at a line sound source, but to the shape of a vibration plate itself, and accordingly in a case where piston motion is performed in a speaker unit including the vibration plate having a particular shape, the speaker unit can reproduce sound also at low frequencies without losing the wide directivity at high frequencies.

Hereinafter, there will be described embodiments of the present invention by reference to the drawings. Specifically, speakers to which electroacoustic transducers according to the present invention are applied will be explained.

FIGS. 1-5 illustrate a speaker according to a first embodiment of the present invention.

The speaker according to the present embodiment (as one example of an electroacoustic transducer) includes: a diaphragm 1; actuators 2 (as one example of a converter) for causing reciprocation of the diaphragm 1; a support frame 3 for supporting the diaphragm 1 and the actuators 2; and an edge member 4 for supporting the diaphragm 1 such that the diaphragm 1 is reciprocable relative to the support frame 3.

Figure 1:
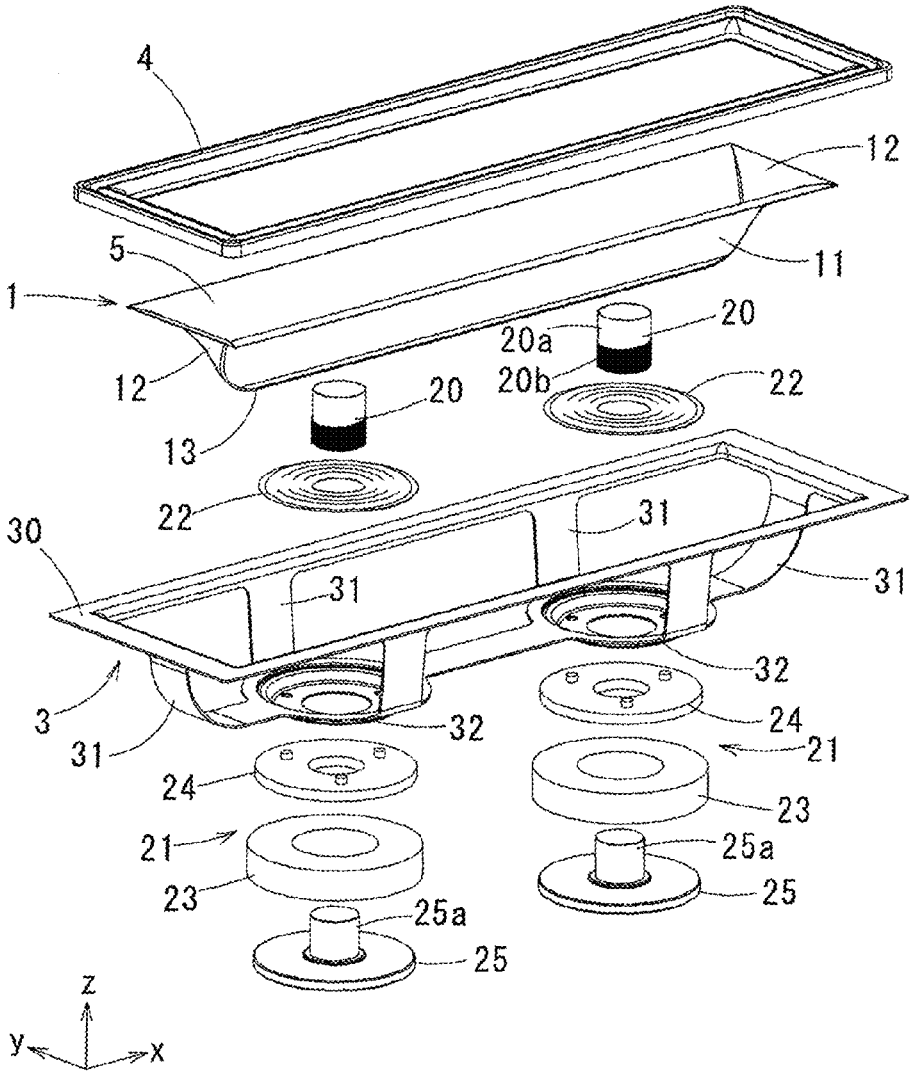
FIG. 1 is an exploded perspective view of a speaker according to a first embodiment of the present invention.
Figure 2:
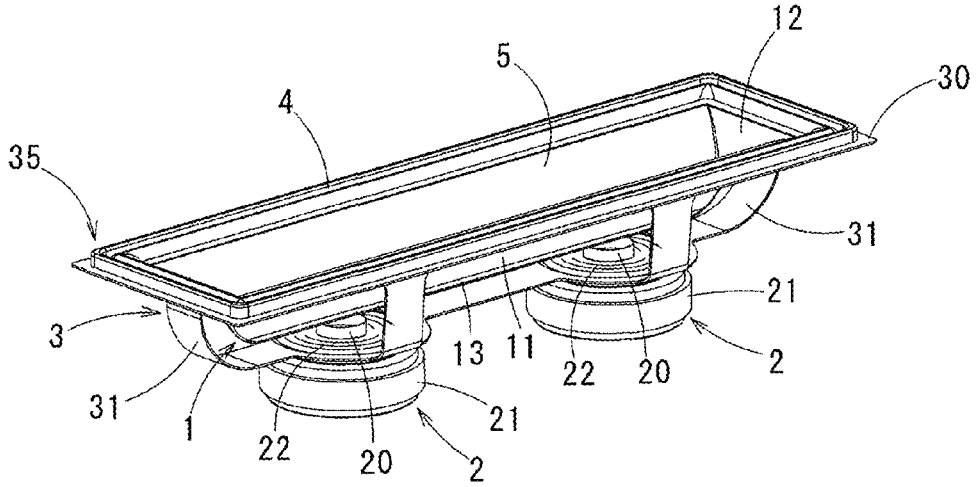
FIG. 2 is a perspective view of the speaker in its assembled state.
Figure 3:
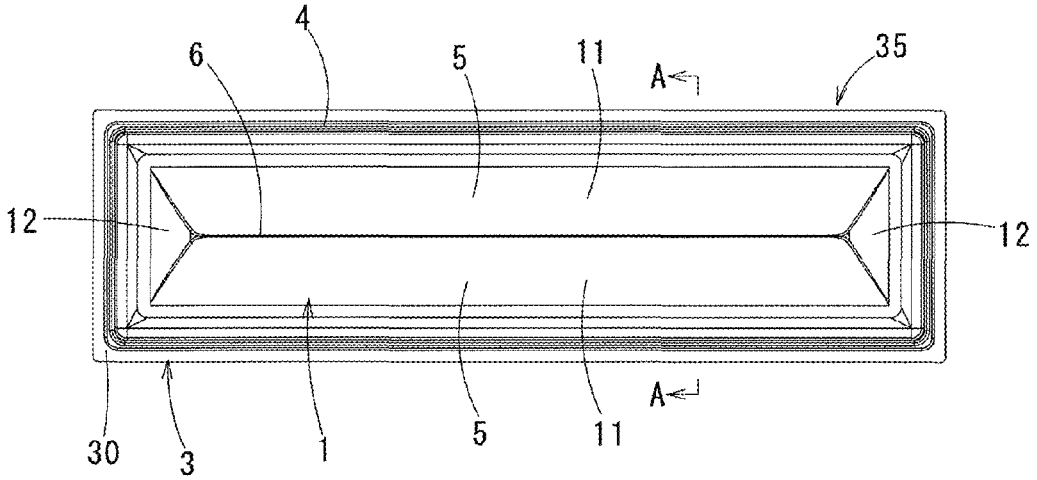
FIG. 3 is a top view of the speaker in FIG. 2.

In the state illustrated in FIG. 1, the up and down direction is defined such that the upper side is a side on which the edge member 4 is provided in FIG. 1, and the lower side is a side on which the actuators 2 are provided in FIG. 1. Also, the lengthwise direction of the support frame 3 having a rectangular shape as will be described below is defined as the front and rear direction, and the widthwise direction of the support frame 3 as the right and left direction. Also, a surface of the support frame 3 which faces upward and a surface thereof which faces downward are respectively defined as a front surface and a back surface. As illustrated in FIG. 1, the front and rear direction, the right and left direction, and the up and down direction may be hereinafter referred to as the x direction, the y direction, and the z direction, respectively.

The diaphragm 1 includes a pair of longitudinal split tubular members respectively having convex surfaces 5 arranged in parallel, and a valley 6 is formed between one side portions of the respective convex surfaces 5 which are adjacent to each other (or between the respective convex surfaces 5 of the pair of longitudinal split tubular members). The surface of the diaphragm 1 is partly constituted by the convex surfaces 5 and a surface of the valley 6. It is noted that the pair of longitudinal split tubular members are two of a plurality of members obtained by splitting a tubular member in its longitudinal direction or the axial direction of the tubular member. The illustrated diaphragm 1 is constituted by a pair of curved plates 11 as the pair of longitudinal split tubular members having the respective convex surfaces 5, and coupling plates 12 which couple these curved plates 11 to each other. Side portions of the curved plates 11 are bonded to each other so as to form the valley 6 of the curved plates 11. The coupling plates 12 are respectively provided at opposite ends of the valley 6 in the front and rear direction so as to close the entire valley 6.

The pair of convex surfaces 5 formed by the pair of curved plates 11 are arranged so as to face each other. In other words, the pair of curved plates 11 are arranged such that the convex surface 5 of one of the pair of curved plates 11 and a concave surface of the other of the pair of curved plates 11 do not face each other and such that concave surfaces of the pair of curved plates 11 do not face each other. The pair of convex surfaces 5 are arranged such that a distance between one edge portions of the pair of convex surfaces 5 is less than a distance between the other edge portions of the pair of convex surfaces 5 or such that the other edge portions of the pair of convex surfaces 5 are spaced apart from each other, and the one edge portions of the pair of convex surfaces 5 are held in contact with each other, whereby the valley 6 having a bottom near the one edge portions is formed between the pair of convex surfaces 5.

In this diaphragm 1, the valley 6 extends in the front and rear direction that is perpendicular to the right and left direction.

This diaphragm 1 may be formed of any material such as synthetic resin, paper, and metal which are typically used for vibration plates of speakers. For example, the diaphragm 1 can be formed relatively easily by vacuum forming of a film formed of synthetic resin such as polypropylene and polyester.

Each of the convex surfaces 5 of the respective curved plates 11 is not limited to a single arc surface and may be a surface having a continuous series of curvatures, a surface whose cross section along the circumferential direction of each convex surface 5 (i.e., in the right and left direction) has a curvature which changes continuously or which is constant like a parabola and a spline curve, a surface shaped like a surface of a polygonal tube, and a surface having a plurality of step portions. Each convex surface 5 in the present embodiment curves in one direction, i.e., the circumferential direction of each convex surface 5 or the right and left direction and extends straight in a direction perpendicular to the one direction, i.e., the front and rear direction (the lengthwise direction of the convex surface 5) or the axial direction of the tubular member of each longitudinal split tubular member. However, each convex surface 5 may be a curved surface or a convex surface formed such that the curvature of a cross section of the surface along the front and rear direction is less than that of a cross section of the surface along the right and left direction (noted that the curvature of the cross section of the surface along the right and left direction may be a constant curvature or a plurality of curvatures which are changed continuously). The pair of curved plates 11 are arranged in parallel so as to project in the same direction, i.e., toward the same surface side, and the adjacent side portions are bonded in a state in which directions of tangents of the respective side portions are coincide with each other. A joint portion 13 of the curved plates 11 is formed by bonding the one side portions of the curved plates 11 to each other, such that the joint portion 13 is shaped like a plate strip. The valley 6 is formed between the curved plates 11 along this joint portion 13 so as to extend along a straight line extending in the lengthwise direction of the convex surface 5.

Figure 4:
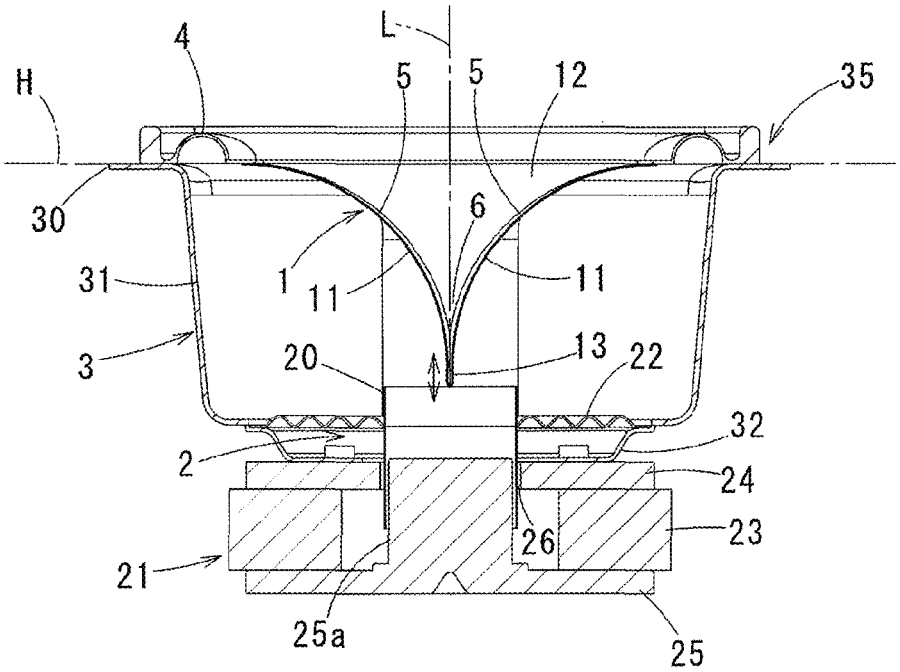
FIG. 4 is a cross-sectional view taken along line A-A in FIG. 3.
Figure 5:
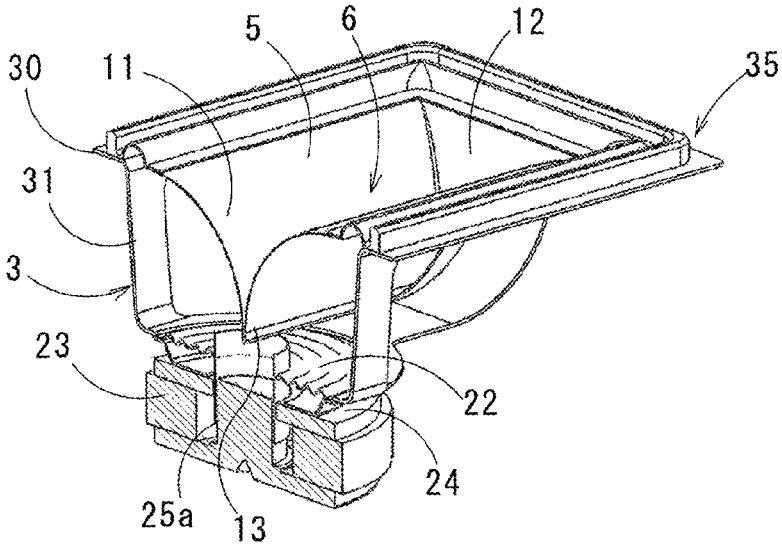
FIG. 5 is a half cross-sectional perspective view taken along line A-A in FIG. 3.

To produce uniform reproduced sound, as illustrated in FIG. 4, the curved plates 11 are preferably formed such that their respective cross sections are symmetric with respect to the tangent L of the joint portion 13. In the present invention, however, the cross sections of the curved plates 11 do not necessarily need to have the line symmetry.

Each of the actuators 2 is, for example, a voice coil motor which is constituted by a voice coil 20 provided on the joint portion 13 of the curved plates 11 and a magnet mechanism 21 secured to the support frame 3. In the example illustrated in FIGS. 1 and 2, the two actuators 2 are provided so as to be spaced apart from each other in the lengthwise direction of the joint portion 13 of the curved plates 11.

Each of the voice coils 20 is constituted by a cylindrical bobbin 20*a* and a coil 20*b* wound on the bobbin 20*a*. An upper end of the voice coil 20 and a lower edge of the joint portion 13 are bonded by, e.g., an adhesive such that the joint portion 13 of the curved plates 11 is disposed in the diameter direction of the voice coil 20. An outer circumferential portion of each of the voice coils 20 is supported by the support frame 3, with a corresponding one of dampers 22 disposed therebetween. The voice coil 20 is reciprocable with respect to the support frame 3 in the axial direction of the voice coil 20. The dampers 22 may be formed of a material which is used for the typical dynamic speaker.

Each of the magnet mechanisms 21 includes an annular magnet 23, a ring-shaped outer yoke 24 secured to one of opposite poles of the magnet 23, and an inner yoke 25 secured to the other of the opposite poles of the magnet 23. A distal end portion of a pole 25*a* standing on a center of the inner yoke 25 is disposed in the outer yoke 24, whereby an annular magnetic gap 26 is formed between the outer yoke 24 and the inner yoke 25, and an end portion of the voice coil 20 is disposed in the magnetic gap 26.

The support frame 3 is formed of metal, for example. In the illustrated example, the support frame 3 includes: a flange portion 30 shaped like a rectangular frame; a plurality of arm portions 31 extending downward from the flange portion 30; and a pair of annular frame portions 32 (respectively corresponding to the actuators 2) formed on lower ends of the respective arm portions 31. The diaphragm 1 is disposed in a space in the flange portion 30 such that the valley 6 is parallel to the lengthwise direction of the flange portion 30. An outer peripheral portion of the diaphragm 1, i.e., a side portions thereof opposite the joint portion 13 of the curved plates 11, and an upper edge portion of the coupling plates 12 are supported by an upper face of the flange portion 30 via the edge member 4. Accordingly, the edge member 4 is shaped like a rectangular frame corresponding to the outer peripheral portion of the diaphragm 1. This edge member 4 can be formed of a material which is used for the typical dynamic speaker. It is noted that the diaphragm 1 and the edge member 4 are formed such that the degree of difficulty in deformation, i.e., stiffness of the diaphragm 1 in the depth direction of the valley 6 is greater than the degree of difficulty in deformation of the edge member 4 in the depth direction of the valley 6, i.e., stiffness of the edge member 4 in the depth direction of the valley 6. In other words, the diaphragm 1 and the edge member 4 are constructed such that an amount of deformation of the diaphragm 1 which is caused by vibration of the diaphragm 1 in the depth direction of the valley 6 is less than an amount of deformation of the edge member 4 which is caused by vibration of the diaphragm 1 in the depth direction of the valley 6.

In the present embodiment, the support frame 3 and the edge member 4 constitute a support portion 35 for supporting the diaphragm 1 such that the diaphragm 1 can be vibrated in the depth direction of the valley 6, i.e., the z direction.

It is noted that one edges of the edge member 4 are secured to outer peripheral portions of the respective curved plates 11 in the right and left direction, i.e., the edge portions of the curved plates 11 (i.e., connection edges of the curved plates 11 which are connected to the edge member 4) which are opposite the edge portions thereof on which the joint portion 13 is provided, and the other edges of the edge member 4 are secured to the support frame 3. Accordingly, deformation of the edge member 4 allows the outer peripheral portion of the respective curved plates 11 to vibrate relative to the support frame 3 in the up and down direction. In other words, the edge member 4 supports the diaphragm 1 while allowing the entire diaphragm 1 to vibrate in the up and down direction.

In a state in which the diaphragm 1 is mounted on the support frame 3, as illustrated in FIG. 4, when it is assumed that a line connecting the edge member 4 and the connection edges of the curved plates 11 (in the illustrated example, the tangent at the connection edges) is defined as a boundary line H, each of the convex surfaces 5 is curved such that the distance between the convex surface 5 and the boundary line H becomes gradually larger in a direction from the corresponding connection edge toward the valley 6.

As described above, each of the convex surfaces 5 is not limited to a single arc surface and may be a surface having a continuous series of curvatures, a surface whose cross section has a curvature which changes continuously or which is constant like a parabola and a spline curve, a surface shaped like a surface of a polygonal tube, and a surface having a plurality of step portions, but each of the convex surfaces 5 is preferably shaped so as not to project from the boundary line H connecting the edge member 4 and the connection edges of the curved plates 11.

Figure 6:
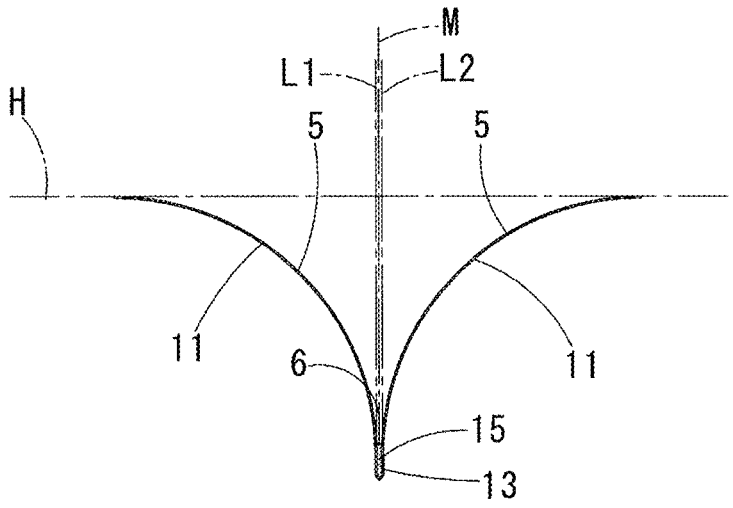
FIG. 6 is an elevational view in vertical cross section illustrating a modification of a diaphragm.
Figure 7:
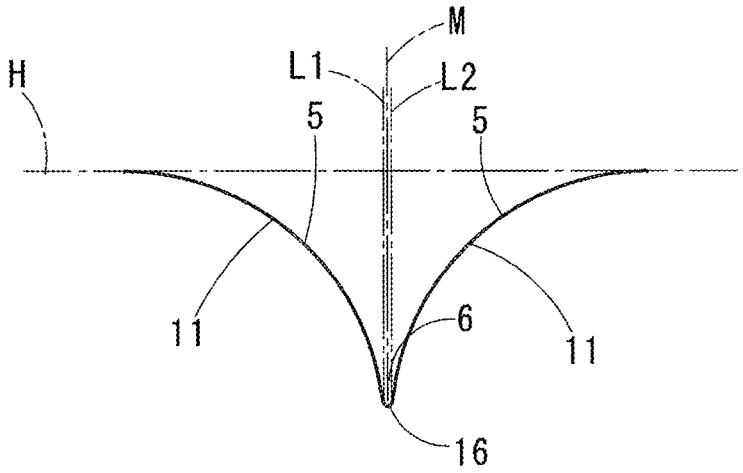
FIG. 7 is an elevational view in vertical cross section illustrating another modification of the diaphragm.

In the above-described embodiment, the joint portion 13 of the curved plates 11 is shaped like a plate strip by bonding the one side portions of the respective curved plates 11 to each other. However, as illustrated in FIG. 6, the one side portions of the respective curved plates 11 may be bonded to each other in a state in which a reinforcing plate 15 shaped like a plate strip is interposed between the one side portions of the respective curved plates 11. Also, as illustrated in FIG. 7, a single film may be folded at its central portion to form a joint portion 16 having a V-shape or a U-shape in cross section between the curved plates 11. As another modification, instead of the reinforcing plate 15 shaped like the plate strip illustrated in FIG. 6, a wire, not shown, may be fixed along the joint portion to keep the joint portion straight. This reinforcing construction using the wire may also be applied to the joint portion 16 of the curved plates 11 illustrated in FIG. 7.

In any construction, each of the convex surfaces 5 is preferably shaped so as not to project from the boundary line H connecting the edge member 4 and the connection edges of the curved plates 11 (not shown in FIGS. 6 and 7). While the convex surfaces 5 have or share the tangent L at the joint portion 13 in the first embodiment, the tangents of the respective convex surfaces 5 may not coincide with each other. As illustrated in FIGS. 6 and 7, the convex surfaces 5 may be constructed such that the joint portion has a width in the right and left direction or the widthwise direction of the convex surfaces 5, and the convex surfaces 5 are formed along tangents L1, L2 which are parallel to each other. In this construction, the curved plates 11 are preferably formed so as to be symmetric with respect to a line M passing through a center between the tangents L1, L2.

In the speaker constructed as described above, when a drive current based on a voice signal is supplied to the voice coils 20 of the respective actuators 2 secured to the diaphragm 1, a driving force generated based on the drive current is applied to the voice coils 20 by a change in magnetic flux generated by the drive current and a magnetic field in the magnetic gap 26, the voice coils 20 are vibrated in a direction perpendicular to the magnetic field (i.e., the axial direction of the voice coil 20 or the up and down direction indicated by the arrows in FIG. 4). When the diaphragm 1 connected to these voice coils 20 vibrates in the depth direction of the valley 6, reproduced sound radiates from the pair of convex surfaces 5 based on their vibrations.

In this construction, the convex surfaces 5 function as vibrating surfaces. Thus, like the vibration plate used in the riffell speaker, the directivity of sound reproduced by the convex surfaces 5 is wide in the right and left direction along the circumferential direction of each convex surface 5 and narrow in the front and rear direction. Also, the directivity of sound reproduced by the convex surfaces 5 is wide at middle and high frequencies as in the vibration plate used in the riffell speaker.

Furthermore, the diaphragm 1 is supported at its outer peripheral portion by the edge member 4 so as to be reciprocable with respect to the support frame 3. Thus, the entire diaphragm 1 extending from the joint portion 13 to the outer peripheral portion vibrates uniformly by the actuators 2, in other words, the diaphragm 1 is vibrated by what is called piston motion. Accordingly, like the dynamic speaker, the diaphragm 1 provides a high sound pressure also at low frequencies. If the opposite ends of the valley 6 are open, a sound wave radiated from the diaphragm 1 partly passes through the openings toward the back side of each curved plate 11. In the above-described embodiment, however, the opposite ends of the valley 6 are closed by the respective coupling plates 12, preventing the sound wave from going toward the back side of each curved plate 11, whereby the diaphragm 1 can efficiently emit sound from the entire front surface of the diaphragm 1.

This construction enables a single speaker unit to function as a full-range speaker unit capable of reproducing sound having wide directivity over the full range of audible frequencies including low frequencies and middle and high frequencies. A line array speaker system can be provided by arranging a plurality of speakers having the above-described construction in a line such that the valleys 6 of the respective vibration bodies 1 are aligned to each other, which can provide a sound space with an ideal line sound source.

Also, each of the voice coils 20 of the actuators 2 has a cylindrical shape whose upper end portion is bonded to the diaphragm 1 in this embodiment. Accordingly, actuators used in a typical dynamic speaker can be used for the actuators 2, resulting in reduced cost for manufacturing.

Each of FIGS. 8-13 illustrates an example in which a reinforcement is provided for keeping the shape of the convex surfaces of the diaphragm. It is noted that the same reference numerals as used in the first embodiment are used to designate the corresponding elements in FIGS. 8-13, and an explanation of which is simplified.

Figure 8:
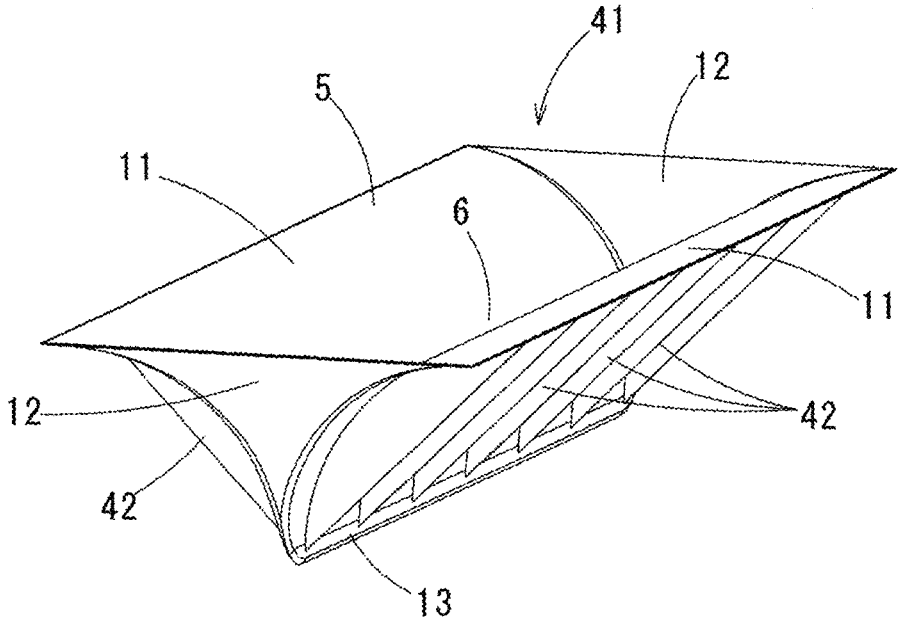
FIG. 8 is a perspective view illustrating one example of a construction for reinforcing the diaphragm.

FIG. 8 illustrates a diaphragm 41 including reinforcements in the form of a plurality of ribs 42 each shaped like a plate extending in the circumferential direction of each convex surface 5. The ribs 42 are provided on back surfaces of the respective curved plates 11 so as to be arranged in parallel and spaced apart from each other in the lengthwise direction of the convex surface 5. Each of these ribs 42 is held in contact with the back surface of a corresponding one of the convex surfaces 5 along its circumferential direction to increase the stiffness of the convex surfaces 5, thereby keeping the shape of the curved plates 11, i.e., a shape in which each curved plate 11 is curved in one direction and extends straight in the front and rear direction.

Figure 9:
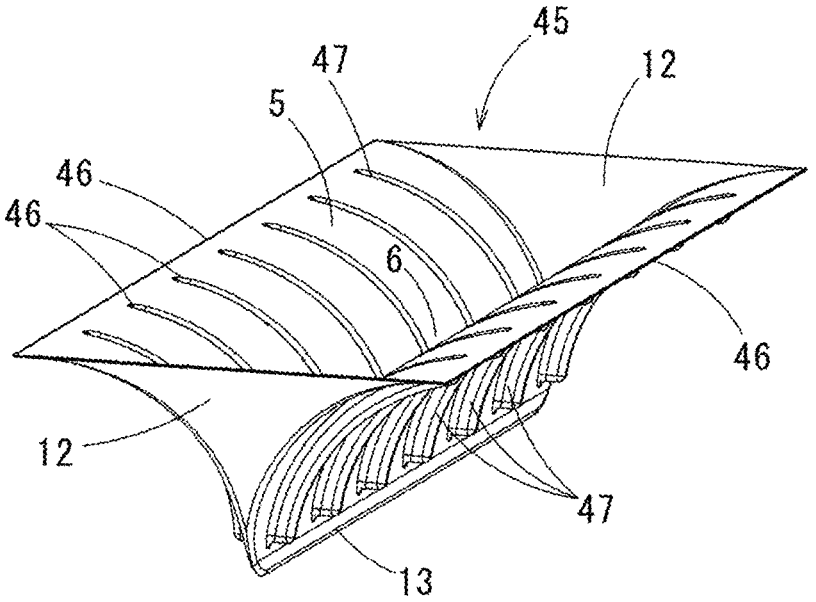
FIG. 9 is a perspective view illustrating another example of the construction for reinforcing the diaphragm.

FIG. 9 illustrates a diaphragm 45 including curved plates 46. The curved plates 46 are formed so as to be partly recessed and projected, whereby reinforcements in the form of a plurality of ribs 47 embossed on the curved plates 46 are formed so as to extend in the circumferential direction of each convex surface 5 and arranged spaced apart from each other in the lengthwise direction of the convex surface 5. In this example, the ribs 47 are curved inwards on a front side of the convex surfaces 5 and curved outwards on a back side thereof. Conversely, the ribs 47 may be curved outwards on a front side of the convex surfaces 5 and curved inwards on a back side thereof. Alternatively, the ribs 47 may be curved outwards and inwards alternately in the lengthwise direction of the convex surface 5.

Figure 10A:
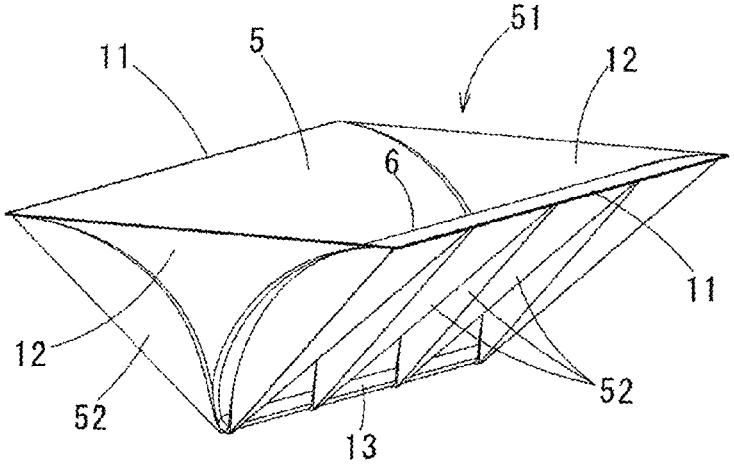
FIGS. 10A and 10B are perspective views illustrating still another example of the construction for reinforcing the diaphragm.
Figure 10B:
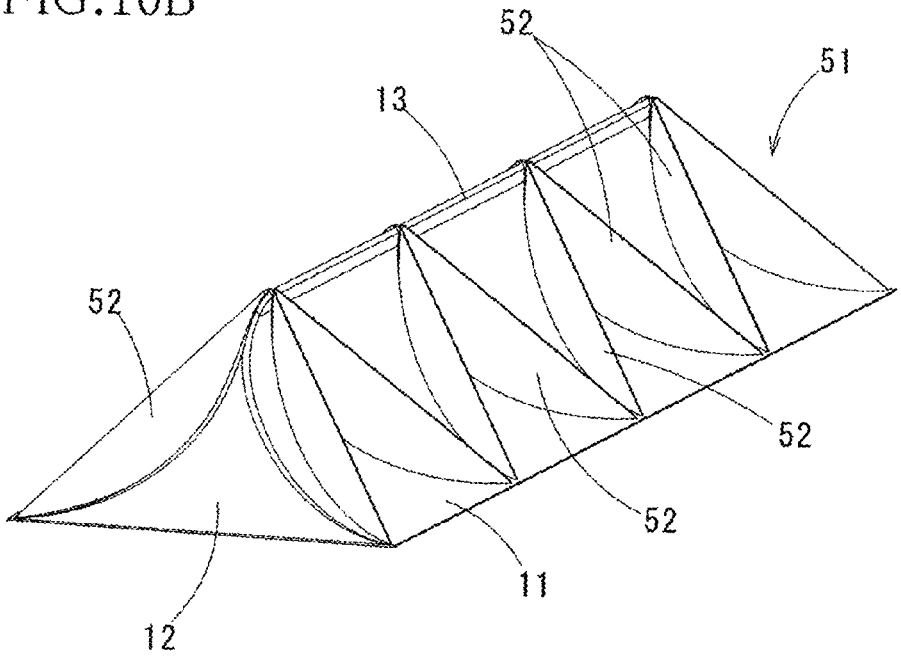

FIGS. 10A and 10B illustrate a diaphragm 51 having a construction similar to that of the diaphragm 41 illustrated in FIG. 8 in that reinforcements in the form of a plurality of ribs 52 each shaped like a plate and provided on a corresponding one of the back surfaces of the respective curved plates 11. However, the diaphragm 51 differs from the diaphragm 41 in that each of the ribs 52 inclines with respect to the circumferential direction of each convex surface 5, and the angle of one of adjacent two of the ribs 52 with respect to the circumferential direction and the angle of the other of the adjacent two of the ribs 52 with respect to the circumferential direction are reverse to each other such that one ends of adjacent two of the ribs 52 are held in contact with each other at one or the other of opposite side portions of the curved plates 11. In this arrangement of the ribs 52, the ribs 52 are arranged over the entire curved plates 11, thereby keeping the shape of the curved plates 11 more firmly.

Figure 11:
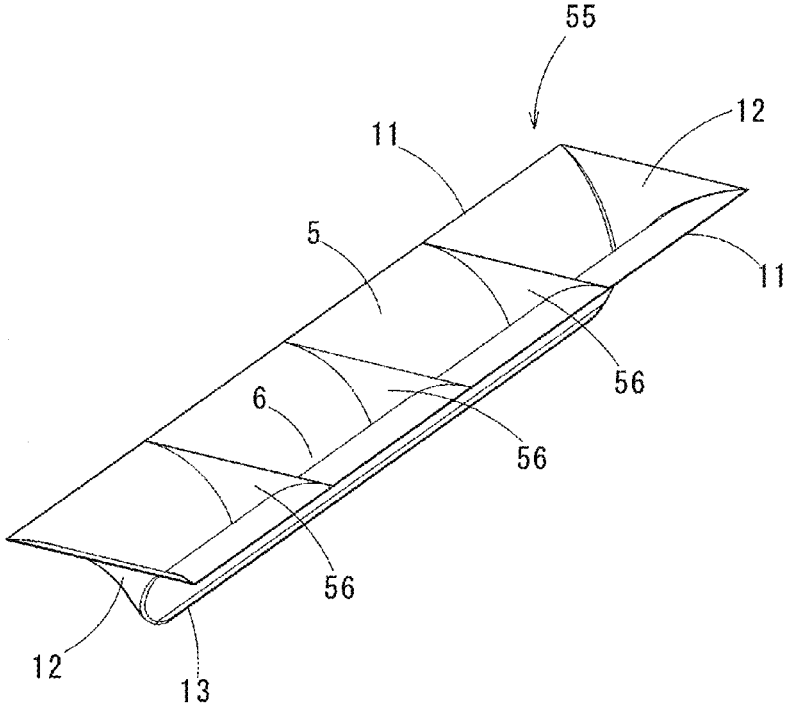
FIG. 11 is a perspective view illustrating still another example of the construction for reinforcing the diaphragm.

FIG. 11 illustrates a diaphragm 55 including reinforcements in the form of a plurality of ribs 56 each shaped like a plate extending in the circumferential direction of each convex surface 5. The ribs 56 are arranged in parallel so as to be spaced apart from each other in the lengthwise direction of the convex surface 5 such that the ribs 56 are fitted in the valley 6 not on the back surfaces of the respective convex surfaces 5 but on the front surfaces of the respective convex surfaces 5.

As described above, in the construction in which the convex surfaces 5 serve as radiation surfaces from which reproduced sound is radiated, the directivity is wide in the right and left direction along the circumferential direction of each convex surface 5 but narrow in the front and rear direction. Accordingly, the plate-like ribs 56 provided on the radiation surfaces of the respective convex surfaces 5 in the right and left direction have little audible effects.

Figure 12:
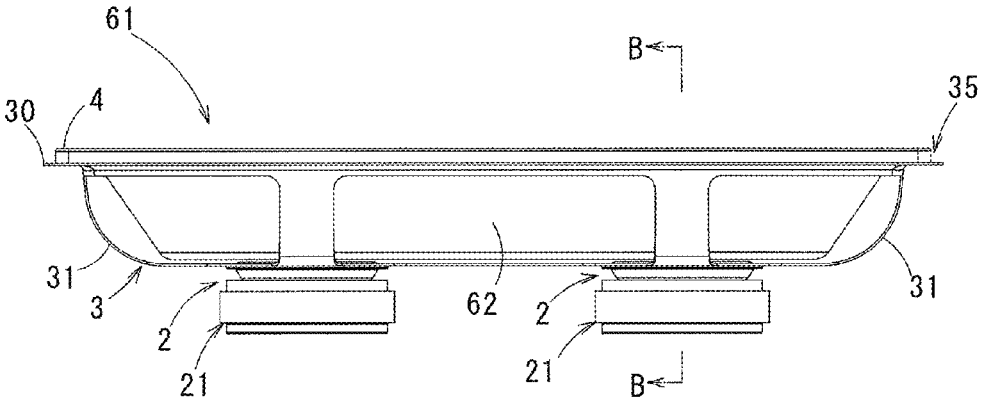
FIG. 12 is a side view illustrating still another example of the construction for reinforcing the diaphragm.
Figure 13:
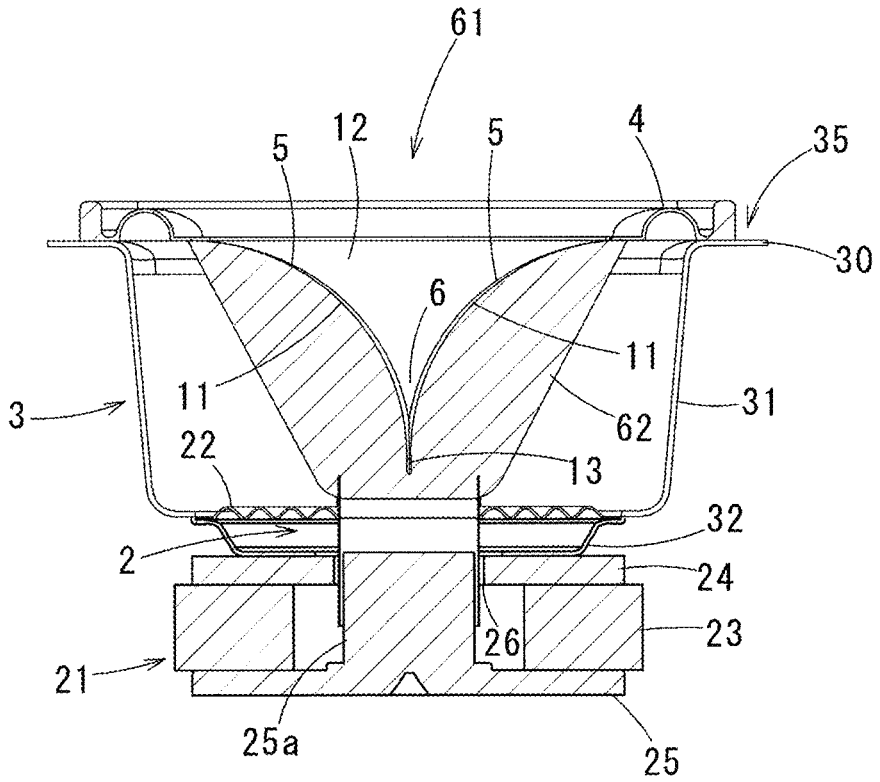
FIG. 13 is a cross-sectional view taken along line B-B in FIG. 12.

FIGS. 12 and 13 illustrate a diaphragm 61 including a block 62 (as one example of a reinforcement) which is bonded to substantially entire back surfaces of the curved plates 11. This block 62 can be formed of a material such as synthetic resin, cork, and wood but is preferably formed of resin foam such as styrofoam and urethane foam for light weight. As illustrated in FIG. 13, this block 62 has such a shape that the lower edge of the joint portion 13 of the curved plates 11 is buried, and upper end portions of the voice coils 20 are fixed in a state in which the upper end portions of the voice coils 20 are buried in the block 62. It is noted that the diaphragm 61 may be configured such that the curved plates 11 and the block 62 are formed integrally with each other and formed of a material such as synthetic resin, cork, and wood.

FIGS. 14-18 illustrate a speaker according to a second embodiment of the present invention. It is noted that the same reference numerals as used in the first embodiment are used to designate the corresponding elements in the second embodiment.

In the speaker according to the present embodiment, an outer peripheral portion of a diaphragm 71 is shaped like a cone which is widely used for dynamic speakers, which provides a cone portion 72 on the outer peripheral portion of the diaphragm 71. Also, a supporter 73 for supporting the diaphragm 71 is constituted by a support frame 75 and a ring-shaped edge member 74. The support frame 75 supports an outer peripheral portion of the cone portion 72 via the edge member 74.

This diaphragm 71 is constituted by: a pair of curved plate portions 76 having the respective convex surfaces 5; and the cone portion 72 extending outward in a state in which the cone portion 72 is coupled to edge portions of opposite end portions of the pair of curved plate portions 76 in the front and rear direction and edge portions of the pair of curved plate portions 76 which are opposite the joint portion 13. The diaphragm 71 can be formed with vacuum forming of a film which is made of synthetic resin. In the illustrated example, this cone portion 72 is shaped like a circular conical surface, and accordingly the edge member 74 also has a round ring shape. However, the curved plate portions may be formed to be longer in its longitudinal direction, whereby the cone portion is shaped like an elliptic conical surface, and the edge member is formed to have an oval ring shape. As long as the cone portion 72 serves as the vibration plate used for the typical dynamic speaker, the cone portion 72 may be any shape other than the shape of the circular conical surface and the shape of the elliptic conical surface. For example, the cone portion 72 may have a circular shape or a quadrangular shape in front view, or a shape in which a circular shape is combined with a quadrangular shape. That is, the cone portion 72 may have any shape as long as the cone portion 72 is conical as a whole. The shape of the pair of curved plate portions 76 is changed as needed according to the shape of the cone portion 72.

Since the pair of curved plate portions 76 and the cone portion 72 are constructed as described above, an outer peripheral portion of the diaphragm 71 is secured to one edge portion of the edge member 74, and the other edge portion (the outer peripheral portion) of the edge member 74 is secured to the support frame 75.

As in the first embodiment illustrated in FIGS. 1-5, the speaker according to the second embodiment includes: the actuators 2 for moving the diaphragm 71 back and forth; and the support frame 75 for supporting the diaphragm 71 and the actuators 2. In this second embodiment, the edge member 74 is shaped like a ring having, e.g., a round shape, and accordingly a flange portion 78 of the support frame 75 on which the edge member 74 is mounted is also shaped like a ring having, e.g., a round shape.

Figure 14:
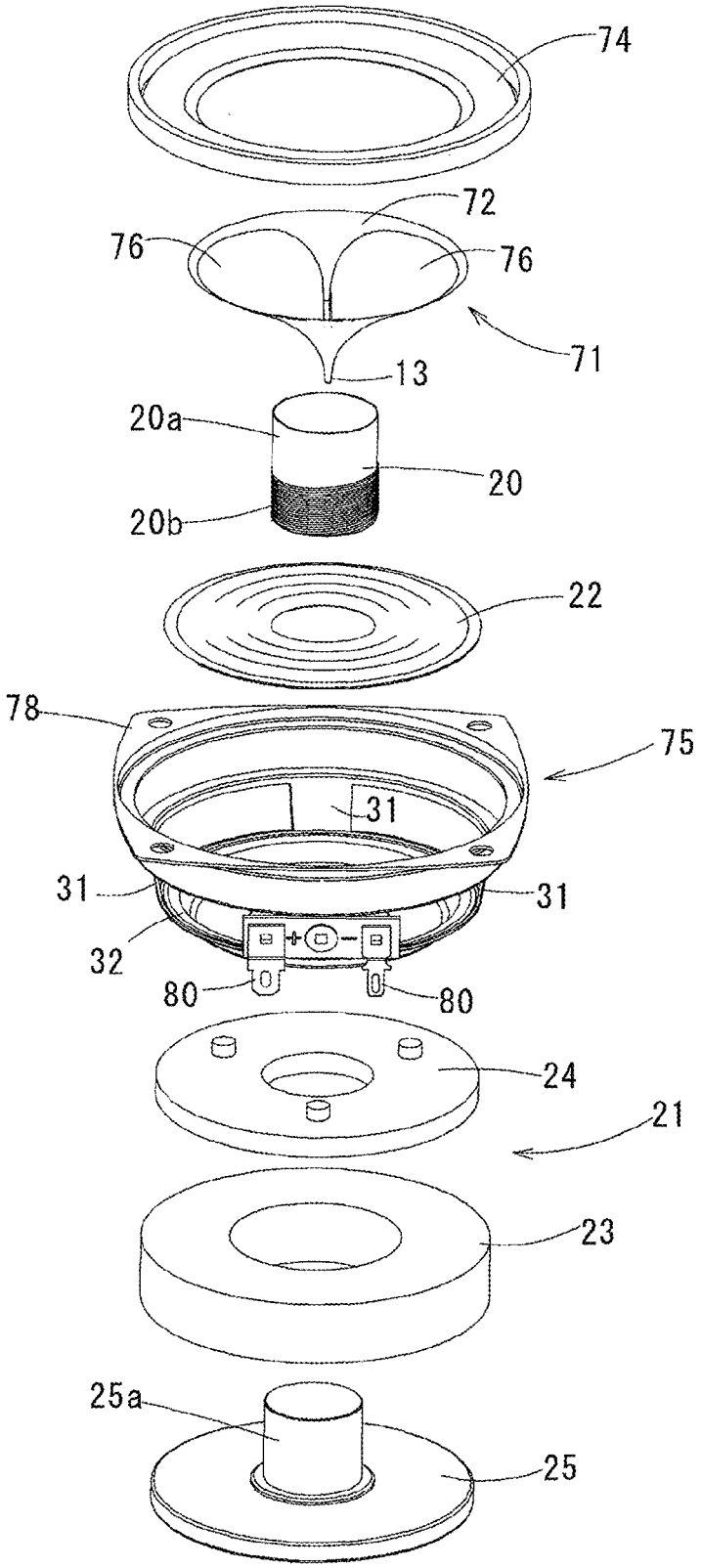
FIG. 14 is an exploded perspective view of a speaker according to the second embodiment of the present invention.
Figure 15:
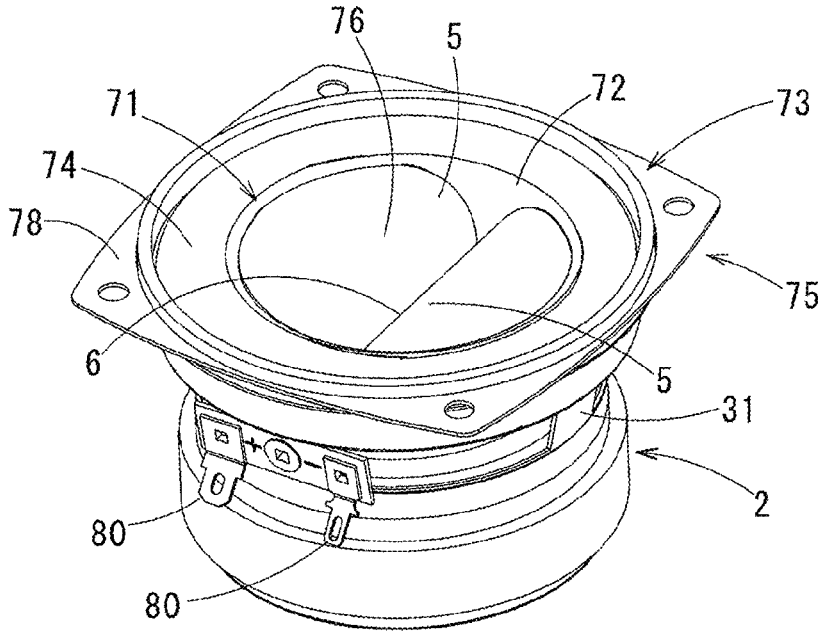
FIG. 15 is a perspective view of the speaker illustrated in FIG. 14 in its assembled state.
Figure 16:
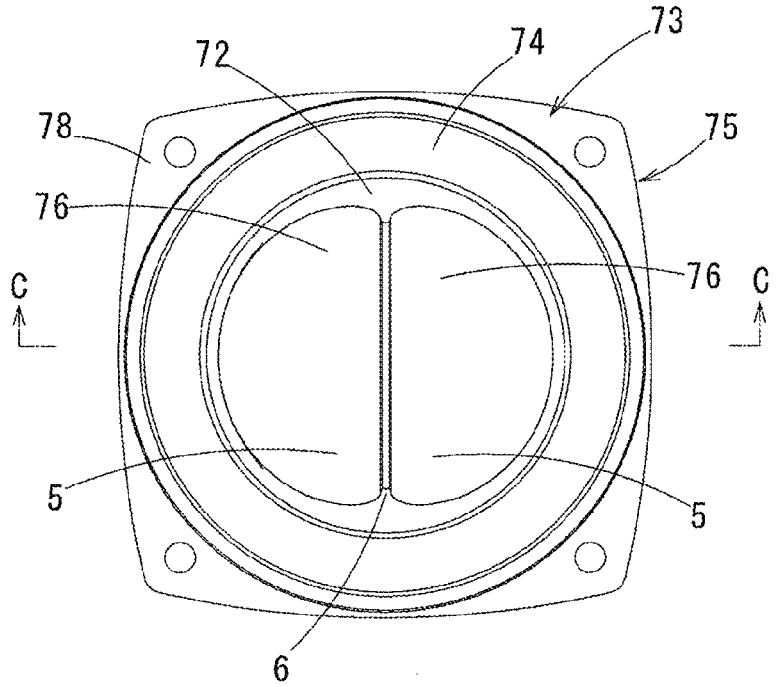
FIG. 16 is a top view of the speaker illustrated in FIG. 15.
Figure 17:
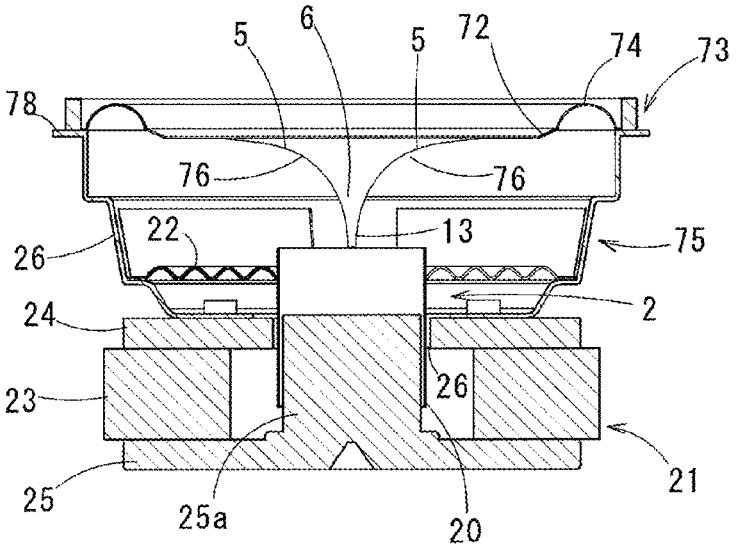
FIG. 17 is a cross-sectional view taken along line C-C in FIG. 16.
Figure 18:
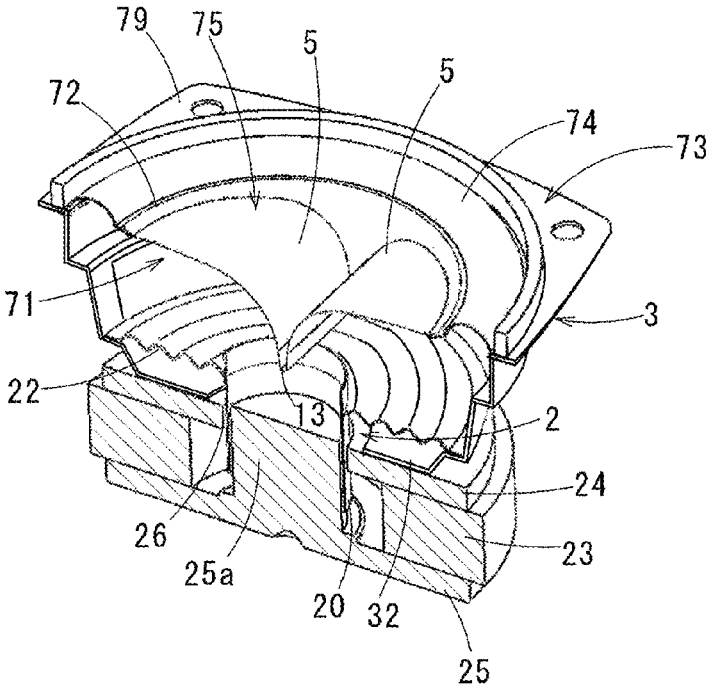
FIG. 18 is a half cross-sectional perspective view taken along line C-C in FIG. 16.

It is noted that reference numerals 80 in FIGS. 14 and 15 denote terminals for connecting the voice coils 20 to external devices.

Since the speaker according to the present embodiment includes the cone portion 72 on the outer peripheral portion of the diaphragm 71, the edge member 74 can be formed to have a simple shape such as a round ring shape. Accordingly, the same components as used in a dynamic speaker including a typical conical vibration plate can be used as components such as the edge member, the support frame, and the actuators, resulting in reduced cost for manufacturing.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

For example, the diaphragm in the first embodiment is constituted by the curved plates and the coupling plates, but the coupling plates may be omitted. Even in the case where the coupling plates are provided, the coupling plates may not cover the entire space between the curved plates and may cover only an upper end portion or a middle portion of the space in the height direction of the curved plates.

Figure 19:
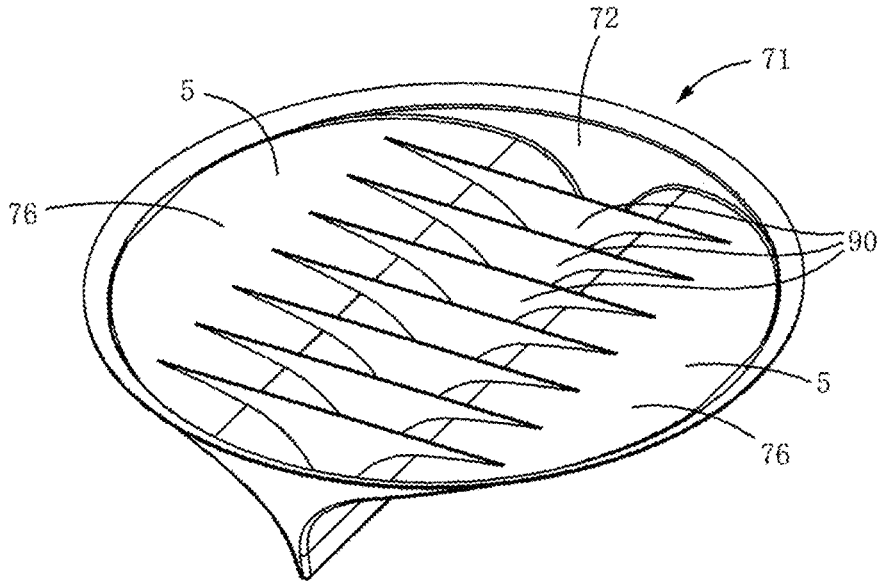
FIG. 19 is a perspective view illustrating a diaphragm as a modification of the speaker according to the second embodiment.

In the diaphragm in the second embodiment, the curved plate portions and the cone portion are formed integrally with each other. However, the diaphragm may be configured such that the curved plate portions are bonded to the front surface of the conical or elliptic conical cone portion. That is, the convex surfaces only have to be formed on the front surface of the diaphragm. As illustrated in FIG. 19, reinforcements in the form of ribs 90 are provided on at least one of the front surface and the back surface of each of the pair of curved plates in the second embodiment. Each of the ribs 90 is secured to the front surface of a corresponding one of the pair of curved plates along the circumferential direction of each convex surface 5 of the pair of curved plate portions 76 of the diaphragm 71. The plurality of ribs 90 are arranged in parallel so as to be spaced uniformly apart from each other in the lengthwise direction of the convex surface 5. In addition to or instead of the plurality of ribs 90, a reinforcement such as a block may be provided on the back surface of each of the pair of curved plates in the second embodiment.

Also, the shape of each of the ribs for reinforcing the diaphragm may not be a plate and may be a rod.

The voice coil motor is used as a converter for moving the diaphragm back and forth, but a piezoelectric element or the like may be used instead of the voice coil motor.

While the two converters are provided on the diaphragm so as to be spaced apart from each other in the front and rear direction (i.e., the x direction) as illustrated in FIG. 1 and other figures, and the single converter is provided on the diaphragm as illustrated in FIG. 14, the number of converters is not limited to one or two, and three or more converters may be arranged so as to be spaced apart from each other in the lengthwise direction of the diaphragm (i.e., the x direction).

While the present invention is applied to the speaker in the above-described embodiments, the present invention may also be applied to a microphone. In the case where the present invention is applied to the speaker, the converter such as the voice coil motor converts the electric signal based on the voice signal into the vibrations of the diaphragm. Also in the case where the present invention is applied to the microphone, the voice coil motor or the like may be used as the converter, and this converter converts, into an electric signal, a vibration of the diaphragm vibrated by a sound wave. In the microphone to which the present invention is applied, the convex surfaces are vibration surfaces, and the entire diaphragm is vibrated uniformly, thereby providing good directivity with reliable sensitivity, whereby the microphone can pick up sound with wide directivity over a wide frequency range from low frequencies to high frequencies.

What is claimed is:

1. An electroacoustic transducer, comprising:

a diaphragm comprising a pair of convex surfaces comprising respectively convex surfaces of a pair of longitudinal split tubular members, a valley being formed between first side portions of the pair of longitudinal split tubular members;

an actuator configured to convert between a vibration of the diaphragm in a depth direction of the valley and an electric signal corresponding to the vibration; and a supporter supporting second side portions of the pair of longitudinal split tubular members of the diaphragm so as to allow said second side portions to vibrate in a vibration direction of the vibration, wherein the supporter comprises:

a support frame supporting the diaphragm and the actuator; and an edge member comprising a first set of opposite side edges which are secured to said second side portions and a second set of opposite side edges which are secured to the support frame, the edge member supporting said second side portions so as to allow the diaphragm to vibrate in the vibration direction, wherein the diaphragm and the edge member are configured such that a stiffness of the diaphragm in the depth direction of the valley is greater than that of the edge member in the depth direction of the valley.

2. The electroacoustic transducer according to claim 1, wherein the diaphragm is configured such that a space formed between the pair of longitudinal split tubular members is closed at opposite ends of the valley respectively by a plurality of coupling plates.

3. The electroacoustic transducer according to claim 1, wherein the diaphragm comprises a pair of curved plates as the pair of longitudinal split tubular members; and a reinforcement configured to keep a curved shape of each of the pair of curved plates.

4. The electroacoustic transducer according to claim 3, wherein the reinforcement is a rib formed on at least one of a front surface and a back surface of each of the curved plates.

5. The electroacoustic transducer according to claim 3, wherein the reinforcement is a block covering a back surface of each of the curved plates.

6. An electroacoustic transducer, comprising:

a diaphragm comprising a pair of convex surfaces comprising respectively convex surfaces of a pair of longitudinal split tubular members, a valley being formed between first side portions of the pair of longitudinal split tubular members;

an actuator configured to convert between a vibration of the diaphragm in a depth direction of the valley and an electric signal corresponding to the vibration; and a supporter supporting second side portions of the pair of longitudinal split tubular members of the diaphragm so as to allow said second side portions to vibrate in a vibration direction of the vibration, wherein the supporter comprises: a support frame; and an edge member supporting an outer peripheral portion of the diaphragm such that the outer peripheral portion of the diaphragm is movable relative to the support frame, wherein the diaphragm comprises a cone portion provided on an outer peripheral portion of each of the pair of longitudinal split tubular members, the cone portion extending from said second side portions of the pair of longitudinal split tubular members so as to be conical in shape, and wherein the edge member is provided on an outer peripheral portion of the cone portion so as to have a ring shape.

7. An electroacoustic transducer, comprising:

a diaphragm comprising a pair of convex surfaces comprising respectively surfaces of a pair of convex members, a distance between first edge portions of the pair of convex surfaces being less than a distance between second edge portions of the pair of convex surfaces so as to form a valley between the pair of convex surfaces;

an actuator configured to convert between a vibration of the diaphragm in a depth direction of the valley and an electric signal corresponding to the vibration;

a support frame supporting the diaphragm and the actuator; and an edge member comprising a first set of opposite side edges which are secured to an outer peripheral portion of the diaphragm and a second set of opposite side edges which are secured to the support frame, the edge member supporting the outer peripheral portion of the diaphragm so as to allow the diaphragm to vibrate in a vibration direction of the diaphragm, wherein the diaphragm and the edge member are configured such that a stiffness of the diaphragm in the depth direction of the valley is greater than that of the edge member in the depth direction of the valley.

8. The electroacoustic transducer according to claim 7, a curvature of each of the pair of convex surfaces is constant or changes continuously.

9. The electroacoustic transducer according to claim 7, wherein a line of intersection of each of the pair of convex surfaces and a plane perpendicular to the vibration direction is a straight line.

10. The electroacoustic transducer according to claim 7, wherein the diaphragm comprises a joint portion which joins the first edge portions of the pair of convex surfaces to each other.

11. The electroacoustic transducer according to claim 7, wherein the diaphragm is configured such that a space formed between the pair of convex surfaces is closed at opposite ends of the valley respectively by a plurality of coupling plates.

12. The electroacoustic transducer according to claim 7, wherein the diaphragm comprises a pair of curved plates as the pair of convex members; and a reinforcement configured to keep a curved shape of each of the pair of curved plates.

13. The electroacoustic transducer according to claim 12, wherein the reinforcement is a rib formed on any of a front surface and a back surface of each of the curved plates.

14. The electroacoustic transducer according to claim 12, wherein the reinforcement is a block covering a back surface of each of the curved plates.

15. An electrostatic transducer, comprising:

a diaphragm comprising a pair of convex surfaces comprising respectively surfaces of a pair of convex members, a distance between first edge portions of the pair of convex surfaces being less than a distance between second edge portions of the pair of convex surfaces so as to form a valley between the pair of convex surfaces;

an actuator configured to convert between a vibration of the diaphragm in a depth direction of the valley and an electric signal corresponding to the vibration;

a support frame supporting the diaphragm and the actuator; and an edge member comprising a first set of opposite side edges which are secured to an outer peripheral portion of the diaphragm and a second set of opposite side edges which are secured to the support frame, the edge member supporting the outer peripheral portion of the diaphragm so as to allow the diaphragm to vibrate in a vibration direction of the diaphragm, wherein the diaphragm comprises a cone portion extending from said second edge portions of the pair of convex surfaces so as to be conical or elliptic conical in shape, and wherein the edge member is provided on an outer peripheral portion of the cone portion so as to have a ring shape.

* * * * *